US010358619B2

(12) United States Patent
Zhang

(10) Patent No.: US 10,358,619 B2
(45) Date of Patent: Jul. 23, 2019

(54) HYDROXY FUNCTIONALIZED ASHLESS ADDITIVE

(71) Applicant: The Lubrizol Corporation, Wickliffe, OH (US)

(72) Inventor: Yanshi Zhang, Solon, OH (US)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 0 days.

(21) Appl. No.: 15/311,625

(22) PCT Filed: May 18, 2015

(86) PCT No.: PCT/US2015/031349

§ 371 (c)(1),
(2) Date: Nov. 16, 2016

(87) PCT Pub. No.: WO2015/179280

PCT Pub. Date: Nov. 26, 2015

(65) Prior Publication Data

US 2017/0081609 A1 Mar. 23, 2017

Related U.S. Application Data

(60) Provisional application No. 62/000,054, filed on May 19, 2014.

(51) Int. Cl.

| | |
|---|---|
| ***C10M 169/04*** | (2006.01) |
| ***C10M 129/90*** | (2006.01) |
| ***C10M 145/02*** | (2006.01) |
| ***F02B 17/00*** | (2006.01) |

(52) U.S. Cl.

CPC ..... *C10M 169/04* (2013.01); *C10M 129/90* (2013.01); *C10M 145/02* (2013.01); *F02B 17/005* (2013.01); *C10M 2203/1006* (2013.01); *C10M 2203/1025* (2013.01); *C10M 2207/021* (2013.01); *C10M 2209/02* (2013.01); *C10M 2223/045* (2013.01); *C10N 2210/02* (2013.01); *C10N 2220/021* (2013.01); *C10N 2230/04* (2013.01); *C10N 2230/10* (2013.01); *C10N 2230/42* (2013.01); *C10N 2230/43* (2013.01); *C10N 2230/45* (2013.01); *C10N 2240/102* (2013.01)

(58) Field of Classification Search

CPC ..... C10M 169/04; C10M 129/90; C10M 145/02; C10M 2203/1025; C10M 2207/021; C10M 2223/045; C10M 2209/02; C10M 2230/10; C10M 2230/45; C10N 2210/02; C10N 2220/021; C10N 2230/04; C10N 2230/42; C10N 2230/43; C10N 2240/102; C10N 2230/10; C10N 2230/45; F02B 17/005

See application file for complete search history.

(56) References Cited

U.S. PATENT DOCUMENTS

| | | | | |
|---|---|---|---|---|
| 4,234,435 | A | 11/1980 | Meinhardt et al. | |
| 4,859,210 | A | 8/1989 | Franz et al. | |
| 6,133,209 | A | 10/2000 | Rath et al. | |
| 6,165,235 | A | 12/2000 | Kolp et al. | |
| 6,533,830 | B1 * | 3/2003 | Oppenlander | C08G 65/2609 44/443 |
| 7,435,273 | B2 * | 10/2008 | Lange | C08G 65/2612 44/442 |
| 2005/0065045 | A1 | 3/2005 | Wilk et al. | |
| 2006/0142503 | A1 | 6/2006 | Lang et al. | |
| 2012/0151830 | A1 * | 6/2012 | Cherpeck | C07C 29/36 44/384 |

FOREIGN PATENT DOCUMENTS

| | | | |
|---|---|---|---|
| WO | 90/05711 | A1 | 5/1990 |
| WO | WO9005711 | * | 5/1990 |
| WO | WO9524431 | * | 9/1995 |

* cited by examiner

*Primary Examiner* — Cephia D Toomer

(74) *Attorney, Agent, or Firm* — Iken Sans; Christopher Hiler

(57) ABSTRACT

The disclosed technology relates to hydroxy functionalized ashless additives useful in engine oil compositions due to their ability to reduce deposits, particularly deposits seen in turbocharged direct injection (TDI) engines. The described additives include ashless saturated compounds having a long chain hydrocarbyl polymer terminated by a hydroxyl group. The disclosed technology also relates to lubricant compositions containing the described additives, processes of making the described additives, and methods of using the described additives.

10 Claims, No Drawings

HYDROXY FUNCTIONALIZED ASHLESS ADDITIVE

CROSS REFERENCE TO RELATED APPLICATION

This application claims priority from PCT Application Serial No. PCT/US2015/031349 filed on May 18, 2015, which claims the benefit of U.S. Provisional Application No. 62/000,054 filed on May 19, 2014, the entirety of which is incorporated by reference.

FIELD OF THE INVENTION

The disclosed technology relates to hydroxy functionalized ashless additives useful in engine oil compositions due to their ability to reduce deposits, particularly deposits seen in turbocharged direct injection (TDI) engines.

BACKGROUND OF THE INVENTION

In TDI engines, a fuel injector sprays atomized fuel directly into the main combustion chamber of each cylinder. This is different from engines that utilize a pre-combustion chamber, which has been prevalent in older indirect injection engines. TDI engines also use forced induction by way of a turbocharger in order to increase the amount of air entering the engine cylinders. TDI engines also typically use an intercooler to increase the amount of fuel that can be injected and combusted per engine cycle. These features allow TDI engines to provide improved engine efficiency, and therefore greater power output, while also decreasing emissions compared to more conventional engine designs.

These benefits, however, come with some challenges. Deposit formation in TDI engines, particularly piston deposit formation, is generally harder to control than it is in other engine designs, likely due to the same features that increase overall efficiency. This may be due to the fact that TDI engines have a low surface area because they have relatively low displacement and are quite compact compared to other engine designs. Regardless of the primary cause, this deposit formation can impact engine performance and result in reduced performance and increased maintenance costs. Thus, there is an ongoing need for additives, and lubricating compositions containing the same, specifically designed for TDI engines, that provide improved deposit control, particularly piston deposit control.

SUMMARY OF THE INVENTION

It has been found that some ashless saturated compounds having a long chain hydrocarbyl polymer terminated by a hydroxyl group can provide improved deposit control, particularly piston deposit control in TDI engines. Accordingly, lubricant compositions with additives comprising a long chain hydrocarbyl polymer terminated by a hydroxyl group are disclosed. The disclosed technology also relates to processes of making and using additives comprising a long chain hydrocarbyl polymer terminated by a hydroxyl group.

The disclosed technology provides a lubricant composition comprising: (i) an oil of lubricating viscosity and (ii) an additive comprising an ashless saturated compound having a long chain hydrocarbyl polymer terminated by a hydroxyl group. As used herein, a hydrocarbyl polymer "terminated" by a hydroxyl group is a hydrocarbyl polymer that has a hydroxyl group located within no more than 6 carbon atoms of the end of the polymer chain, and in some embodiments is located within no more than 5, 4, 3, 2, or even 1 carbon atom of the polymer chain, and in still further embodiments is located on the final carbon atom in the polymer chain. The term "terminal hydroxyl group" may also be used herein, which incorporates the same definition of terminated.

The disclosed technology also provides the described lubricant composition where the additive is prepared from a long chain ethylenically unsaturated hydrocarbon polymer by means of a hydroboration and oxidation sequence.

The disclosed technology also provides the described lubricant composition where the additive is formed by reacting a long chain ethylenically unsaturated hydrocarbon polymer with a borane derivative, and then reacting the resulting intermediate with a peroxide derivative and a base.

The disclosed technology also provides the described lubricant composition where the additive is prepared by reacting a long chain ethylenically unsaturated hydrocarbon polymer with borane in the presence of dimethyl sulfide, and then reacting the resulting intermediate with hydrogen peroxide in the presence of dimethyl sulfide and a base.

The disclosed technology also provides the described lubricant composition where the additive is prepared by reacting a long chain ethylenically unsaturated hydrocarbon polymer with $CO/H_2$ in the presence of a metal catalyst, resulting in an aldehyde, and then completing a hydrogenation or a reduction of the aldehyde to the saturated alcohol.

The disclosed technology also provides the described lubricant composition where the long chain ethylenically unsaturated hydrocarbyl group is a polyolefin of number average molecular weight ($M_n$) of from about 140 to about 5000, or from 200 to 2500, or from 300 to 3000, or from 500 to 2000, or from 500 to 1500, or from 900 to 1100, or even about 1000. Alternatively, the disclosed technology also provides the described lubricant composition where the long chain ethylenically unsaturated hydrocarbyl group comprises from about 10 to about 600 carbon atoms, or from 10 to 360, or from 14 to 200, or from 30 to 150 or from 30 to 110 or even from 60 to 80 carbon atoms.

The disclosed technology also provides the described lubricant composition where the additive includes compounds having at least one of the following structures:

(i)

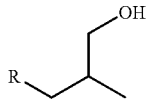

(ii)

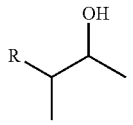

(iii)

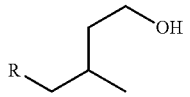

(iv)

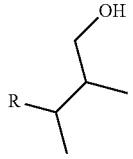

-continued (v)

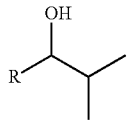

(vi)

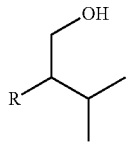

where R is a hydrocarbyl group containing from about 6 to about 596 carbon atoms.

The disclosed technology also provides the described lubricant composition where the additive is present in the overall lubricant composition from about 0.1 to about 4.0 percent by weight.

The disclosed technology also provides the described lubricant composition where the additive comprises a long chain polyisobutylene polymer terminated by a hydroxyl group.

The disclosed technology also provides the described lubricant composition where the additive is prepared by reacting a long chain ethylenically unsaturated polyisobutylene polymer with borane in the presence of dimethyl sulfide, and then reacting the resulting intermediate with hydrogen peroxide in the presence of dimethyl sulfide and a base.

The disclosed technology also provides the described lubricant composition where the polyisobutylene polymer has a number average molecular weight of from about 300 to 3000 or from 1500 to about 2500 and a vinylidene content of at least 70 percent by weight.

The disclosed technology also provides the described lubricant composition where the oil of lubricating viscosity comprises a mineral oil, a synthetic oil, or a combination thereof.

The disclosed technology also provides the described lubricant composition where the lubricant composition further comprises (iii) an additive package, where the additive package comprises one or more viscosity modifiers, pour point depressants, antioxidants, friction modifiers, detergents, antiwear agents, corrosion inhibitors, antifoam agents, diluent oil, or any combination thereof.

The disclosed technology also provides the described lubricant composition where the composition is an engine oil composition for a turbocharged direct injection (TDI) engine.

The disclosed technology further provides methods of operating an internal combustion engine utilizing the described lubricant composition. These methods include the steps of: (1) supplying to the engine the lubricant composition described herein, and (2) operating the engine. In some embodiments, the engine is a turbocharged direct injection (TDI) engine.

The disclosed technology further provides for the use of an additive in a lubricant composition to reduce deposit control in a turbocharged direct injection (TDI) engine that utilizes said lubricant composition, where the additive may be any of the additives described herein and/or where the lubricant composition may be any of the lubricant compositions described herein. That is, the additive includes an ashless saturated compound having a long chain hydrocarbyl polymer terminated by a hydroxyl group.

DETAILED DESCRIPTION OF THE INVENTION

Various features and embodiments will be described below by way of non-limiting illustration.

The disclosed technology involves a lubricant composition that includes: (i) an oil of lubricating viscosity; and (ii) an additive comprising an ashless saturated compound having a long chain hydrocarbyl polymer terminated by a hydroxyl group.

The additive is ashless, in that it may be described as containing no metal or other ash producing component.

The additive is saturated, in that it may be described as containing no double bonds, no triple bonds and no rings.

The additive is a long chain hydrocarbyl polymer terminated by a hydroxyl group, where the polymer chain of the additive may have a number average molecular weight of from about 140 to about 5000, or from 200 to 2500, or from 300 to 3000, or from 500 to 2000, or from 500 to 1500, or from 900 to 1100, or even about 1000. In some embodiments, the polymer chain of the additive may be described as having from about 10 to about 600 carbon atoms, or from 10 to 360, or from 14 to 200, or from 30 to 150 or from 30 to 110 or even from 60 to 80 carbon atoms.

The additive itself may have one or more of the following structures:

(i)

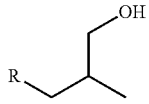

(ii)

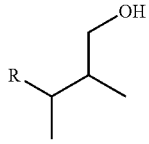

(v)

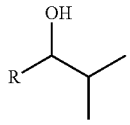

where R is a hydrocarbyl group containing from about 6 to about 596 carbon atoms.

In some embodiments, the additive includes compounds described by structure (i) above. In some embodiments, the additive includes compounds described by structure (ii) and/or (v) above. In some embodiments, the additive includes a combination of compounds described by structures (i), (ii), and/or (v) above. In other words, possible combinations include, but are not limited to, (i) and (ii), (i) and (v), (ii) and (v), or (i), (ii), and (v).

In some embodiments, the additive itself may have one or more of the following structures:

(iii)

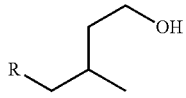

-continued (iv)

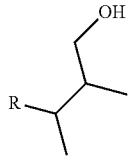

(vi)

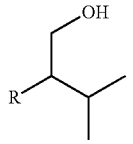

where R is a hydrocarbyl group containing from about 6 to about 596 carbon atoms.

In some embodiments, the additive includes compounds described by structure (iii) above. In some embodiments, the additive includes compounds described by structure (iv) and/or (vi) above. In some embodiments, the additive includes a combination of compounds described by structures (iii), (iv), and (vi) above. In some embodiments, the additive includes a combination of compounds described by structures (iii), (iv), and/or (vi) above. In other words, possible combinations include, but are not limited to, (iii) and (iv), (iii) and (vi), (iv) and (vi), or (iii), (iv), and (vi).

In still further embodiments, the additive includes a combination of compounds described by two or more of structures (i), (ii), (iii), (iv), (v), and (vi). In other embodiments, the additive is free of structures (iii) (iv), and/or (vi).

As used herein, the term "hydrocarbyl" or "hydrocarbyl substituent" or "hydrocarbyl group" are used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of the disclosed technology, do not alter the predominantly hydrocarbon nature of the substituent or its functionality; and hetero substituents, that is, substituents which similarly have a predominantly hydrocarbon character but contain other than carbon in a ring or chain. A more detailed definition of the term "hydrocarbyl substituent" or "hydrocarbyl group" is found near the end of this document.

In some embodiments, the long chain ethylenically unsaturated hydrocarbon polymer used to prepare the additive can be linear or branched and consist of carbon and hydrogen atoms. The polymer section of the additive may itself be a long chain hydrocarbon polymer, but at that point it would be fully saturated.

The long chain ethylenically unsaturated hydrocarbon polymer used to prepare the additive may have a high methylvinylidene isomer content. These include the hydrocarbyl groups wherein at least about 50% by weight, and in other embodiments at least about 60% or even 70% by weight, of the hydrocarbyl groups have methylvinylidene end groups.

In some embodiments, the long chain hydrocarbyl group can be a polyolefin. The polyolefin employed to produce the reaction product may be a homopolymer, copolymer, or interpolymer. The polyolefin may be prepared from polymerisable monomers containing about 2 to about 16, or about 2 to about 8, or about 2 to about 6 carbon atoms. Often the polymerisable monomers comprise one or more of ethylene, propylene, isobutene, 1-butene, isoprene, 1,3-butadiene, decene or mixtures thereof.

The polyolefin may be a "conventional" ("CONV") polyolefin or a "high vinylidene" ("HV") polyolefin. The difference between a conventional polyolefin and a high vinylidene polyolefin can be illustrated by reference to the production of poly(isobutylene) ("PIB"). In a process for producing conventional PIB ("CONV PIB") (a), isobutylene is polymerized in the presence of $AlCl_3$ to produce a mixture of polymers comprising predominantly trisubstituted olefin (III) and tetrasubstituted olefin (IV) end groups, with only a very small amount (for instance, less than 20 percent) of chains containing a terminal vinylidene group (I). In an alternative process, (b), isobutylene is polymerized in the presence of a boron catalyst, such as $BF_3$, to produce a mixture of polymers comprising predominantly (for instance, at least 70 percent) terminal vinylidene groups, with smaller amounts of tetrasubstituted end groups and other structures. The materials produced in the alternative method, sometimes referred to as "high vinylidene PIB" ("HV PIB"), are also described in U.S. Pat. No. 6,165,235. In some embodiments, the CONV PIB and the HV PIB used in the disclosed technology may have the following characteristics:

TABLE 1

| ID | PIB Terminal Groups | WT % in CONV PIB | WT % in HV PIB |
|---|---|---|---|
| I | 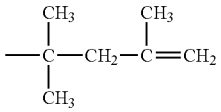 | 4 to 5 | 50 to 90 |
| II | 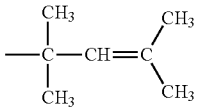 | 0 to 2 | 6 to 35 |
| III | 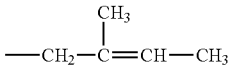 | 63 to 67 tri-substituted | 0 to 5 |
| IV | 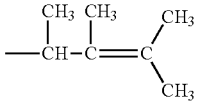 | 22 to 28 tetra-substituted | 1 to 15 |
| IVa | 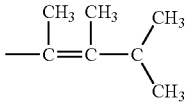 | | |
| V | 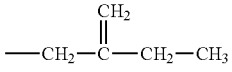 | 5 to 8 | 0 to 4 |
| VI | Other. | 0 to 10 | none |

Typical examples of a polyolefin include PIB; polypropylene; polyethylene; a copolymer derived from isobutene and butadiene; a copolymer derived from isobutene and isoprene; or mixtures thereof. Useful polyolefins include PIBs having a number average molecular weight of 140 to 5000, in another instance of 400 to 2500, in another instance from 300 to 3000, and in a further instance of 140 or 500 to 1500. The PIB may have a vinylidene double bond content of 5 to 69%, in a second instance of 50 to 69%, and in a third instance of 50 to 95%.

In some embodiments, the described additive is prepared from a long chain ethylenically unsaturated hydrocarbon polymer by means of a hydroboration and oxidation sequence.

Reagents suitable for use in completing the descried hydroboration include but may not be restricted to 9-borabicyclo[3.3.1]nonane borane N-ethyl-N-isopropylaniline complex, dioxane-monochloroborane and (di)borane dissolved or complexed with a suitable solvent such as dimethyl sulfide, tetrahydrofuran, pyridine, diethylether, disiamylborane, or any combination thereof. Suitable reagents also include borane-ammonia complex, diborane, borane dimethyl sulfide complex, borane dimethylamine complex, borane trimethylamine complex, dicyclohexylborane, borane N,N-diethylaniline complex, borane 2,6-lutidine complex, borane 4-(dimethylamino)pyridine complex, borane pyridine complex, borane morpholine complex, or any combinations thereof. In some embodiments, borane is used for the hydroboration.

Reagents suitable for use in completing the descried oxidation include but may not be restricted to nearly any suitable oxidising agent, for example, sodium perborate, hydrogen peroxide, or any combination thereof. In some embodiments, hydrogen peroxide is used for the oxidation.

The additive may be prepared by reacting a long chain ethylenically unsaturated hydrocarbon polymer with borane in the presence of dimethyl sulfide, and then reacting the resulting intermediate with hydrogen peroxide in the presence of dimethyl sulfide and a base.

Persons of ordinary skill in the art will recognize that the additive produced may depend on the type of ethylenically unsaturated hydrocarbon polymer used. Without limiting this disclosure to one theory of operation, the additives may be produced using one or more of the hydroboration reactions:

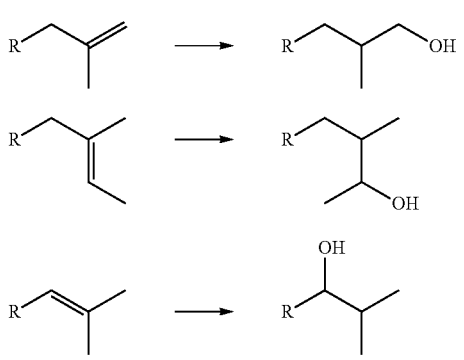

where R is a hydrocarbyl group containing from about 6 to about 596 carbon atoms.

The additives described herein may also be prepared using hydroformulation and/or hydrogenation sequences, which are sometimes also referred to as oxo synthesis. In such embodiments, the long chain ethylenically unsaturated hydrocarbon polymer is converted by $H_2$/CO in the presence of a catalyst to result in a fully saturated alcohol. Metal mediated hydroformulation and/or hydrogenation is known in the art, and can be carried out by conventional methods with transition metals such as rhodium or cobalt as the catalyst. Hydroformulation reactions may be carried out in the range between 25 and 200° C., and under a pressure in the range of 1 to 350 bar of CO/$H_2$. The hydroformulation reaction is followed by hydrogenation or reduction of the aldehyde to form the saturated alcohol derivatives.

Persons of ordinary skill in the art will recognize that the additive produced may depend on the type of ethylenically unsaturated hydrocarbon polymer used. Without limiting this disclosure to one theory of operation, the additives may be produced using one or more of the hydroformulation reactions:

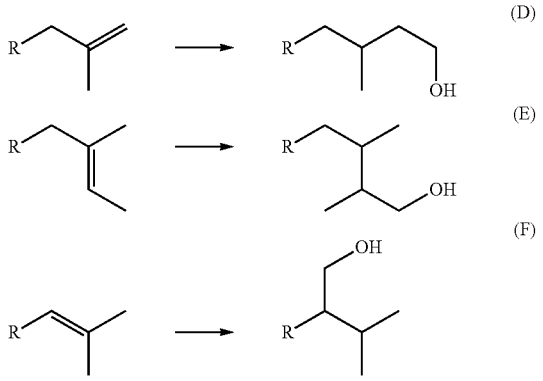

where R is a hydrocarbyl group containing from about 6 to about 596 carbon atoms.

In some embodiments, hydrogen peroxide is used. The reaction in the preparation of the reaction product involves the acid catalyzed addition of one or more equivalents of the hydrogen peroxide.

In any of these methods of preparation, the conditions for the reaction of the long chain hydrocarbyl group with the hydrogen peroxide, and the relative concentrations of such components, should preferably be sufficient that a majority of the long chain hydrocarbyl group has reacted with at least one molecule of the hydrogen peroxide, or reactive equivalents thereof. That is, in some embodiments no more than 30 percent by weight PIB or other long chain hydrocarbyl group should remain unreacted in the resulting additive, or even no more than 25 percent, or even no more than 20 percent. Determination of conditions to assure a sufficient degree of reaction is within the abilities of the person skilled in the art.

The reaction in the preparation of the reaction product involves the acid catalyzed addition of one or more equivalents of the hydrogen peroxide to the borated polyolefin.

The disclosed technology provides a lubricant composition containing the additive described above. In such lubricant compositions the additive may be present in the overall lubricant composition from about 0.1 to about 4.0 percent by weight, or from 0.1 to 2.0, or from 0.1 to 2.0, or from 0.5 to 1.5, or from 0.9 to 1.1, or even about 1.0 percent by weight. The lubricant compositions will also include an oil of lubricating viscosity, and will generally include one or more additional additives. These additional additives may be present in the overall lubricant composition from 0 or 0.1 to 30 percent by weight, or from 1 to 20, or from 5 to 20, or from 10 to 20, or from 10 to 15, or even about 14 percent by weight. The oil of lubricating viscosity will in some embodiments make up the balance of the composition, and/or may be present from 66 to 99.9 or 99.8 percent by weight, or from 78 to 98.9, or from 78.5 to 94.5, or from 78.9 to 89.1, or from 83.9 to 89.1, or even about 85 percent by weight.

The oils of lubricating viscosity of can include, for example, natural and synthetic oils, oil derived from hydrocracking, hydrogenation, and hydrofinishing, unrefined, refined and re-refined oils and mixtures thereof. Oils of lubricating viscosity may also be defined as specified in the American Petroleum Institute (API) Base Oil Interchangeability Guidelines.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products. Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof. Synthetic lubricating oils are useful and include hydrocarbon oils such as polymerised and interpolymerised olefins (e.g., polybutylenes, poly-propylenes, propyleneisobutylene copolymers); poly(1-hexenes), poly(1-octenes), poly(1-decenes), and mixtures thereof alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof. Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥0.90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively, the oil of lubricating viscosity is often an API Group II, Group III or Group IV oil or mixtures thereof. In some embodiments, the oil of lubricating viscosity used in the described lubricant compositions includes a Group III base oil.

The amount of the oil of lubricating viscosity present is typically the balance remaining after subtracting from 100 wt % the sum of the amount of the additive as described herein above, and the other performance additives.

It is noted that the lubricant composition may be in the form of a concentrate and/or a fully formulated lubricant. For a concentrate, the relative amounts of additives would remain the same but the amount of base oil would be reduced. In such embodiments, the percent by weights of the additive may be treated as parts by weight, with the balance of the concentrate composition being made up of the desired amount of base oil.

The additional additives which may also be present may include a dispersant comprising at least one of a carboxylic, amine, Mannich, post-treated, and polymeric dispersant. Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include carboxylic dispersants, such as, for example, N-substituted long chain alkenyl succinimides. Examples of N-substituted long chain alkenyl succinimides include PIB succinimide with number average molecular weight of the PIB substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a poly(ethyleneamine) or an aromatic polyamine, such as amino diphenylamine (ADPA).

In one embodiment, the additional additives present in the lubricant composition may further include an amine dispersant, such as, for example, the reaction product of a PIB succinic anhydride and an amine, preferably a polyamine, and preferably an aliphatic polyamine, such as ethylene polyamine (i.e., a poly(ethyleneamine)), a propylene polyamine, a butylene polyamine, or a mixture of two or more thereof. The aliphatic polyamine may be ethylene polyamine. The aliphatic polyamine may be selected from ethylenediamine, diethylenetriamine, triethylenetetramine, tetraethylenepentamine, pentaethylenehexamine, polyamine still bottoms, or a mixture of two or more thereof.

In one embodiment, the additional additives present in the lubricant composition may further include at least one PIB succinimide dispersant derived from PIB with number average molecular weight in the range 350 to 5000, or 500 to 3000. The PIB succinimide may be used alone or in combination with other dispersants. Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

Any of the described dispersants may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, phosphorus compounds and/or metal compounds.

The optional dispersant can also be a polymeric dispersant. Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates.

The optional dispersants described above may be present at 0 wt % to 20 wt %, or 0.1 wt % to 15 wt %, or 0.1 wt % to 10 wt %, or 1 wt % to 6 wt %, or 3 wt % to 12 wt % of the lubricating composition.

The additional additives present in the lubricant composition may further include conventional detergents (detergents prepared by processes known in the art). Most conventional detergents used in the field of engine lubrication obtain most or all of their basicity or total base number ("TBN") from the presence of basic metal-containing compounds (metal hydroxides, oxides, or carbonates, typically based on such metals as calcium, magnesium, zinc, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an inert, organic solvent (e.g., mineral oil, naphtha, toluene, xylene) for the acidic organic substrate. Typically, a small amount of promoter such as a phenol or alcohol is also present, and in some cases a small amount of water. The acidic organic substrate will normally have a sufficient number of carbon atoms to provide a degree of solubility in oil.

The overbased metal-containing detergent may be selected from the group consisting of non-sulfur containing phenates, sulfur containing phenates, sulfonates, salixarates, salicylates, and mixtures thereof, or borated equivalents thereof. The overbased detergent may be borated with a borating agent such as boric acid.

Overbased detergents are known in the art. In one embodiment, the sulfonate detergent may be a predominantly linear alkylbenzene sulfonate detergent having a metal ratio of at least 8 as is described in paragraphs [0026] to [0037] of US Patent Application 2005-065045. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

In one embodiment, the overbased metal-containing detergent is calcium or magnesium overbased detergent. In one embodiment, the lubricating composition comprises an overbased calcium sulfonate, an overbased calcium phenate, or mixtures thereof. The overbased detergent may comprise calcium sulfonate with a metal ratio of at least 3.

The overbased detergent may be present in an amount from 0.05% by weight to 5% by weight of the composition. In other embodiments, the overbased detergent may be present from 0.1%, 0.3%, or 0.5% up to 3.2%, 1.7%, or 0.9% by weight of the lubricating composition. Similarly, the overbased detergent may be present in an amount suitable to provide from 1 TBN to 10 TBN to the lubricating composition. In other embodiments, the overbased detergent is present in amount which provides from 1.5 TBN or 2 TBN up to 3 TBN, 5 TBN, or 7 TBN to the lubricating composition. TBN is a measure of the reserve of basicity of a lubricant by potentiometric titration. Commonly used method are ASTM D4739 & D2896.

The additional additives present in the lubricant composition may further include one or more additional performance additives as well. The other performance additives can include at least one of metal deactivators, viscosity modifiers, friction modifiers, antiwear agents, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

The total combined amount of the optional performance additives present in one embodiment can be from 0 or 0.01 wt % to 50 wt %, in another embodiment 0 or 0.01 to 40 wt %, in another embodiment 0 or 0.01 to 30 wt % and in another embodiment 0.05 or 0.1 or 0.5 to 20 wt % of the lubricating composition. In one embodiment, the total combined amount of the additional performance additive compounds present on an oil free basis ranges from 0 wt % to 25 wt % or 0.01 wt % to 20 wt % of the composition. Although, one or more of the other performance additives may be present, it is common for the other performance additives to be present in different amounts relative to each other.

The lubricating composition may be utilized in an internal combustion engine. The internal combustion engine may or may not have an Exhaust Gas Recirculation system. In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment, the engine may be a spark ignited engine and in one embodiment a compression engine. The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment, the sulfur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment, the phosphorus content may be 100 ppm to 1000 ppm, or 325 ppm to 700 ppm. The total sulfated ash content may be 2 wt % or less, or 1.5 wt % or less, or 1.1 wt % or less, or 1 wt % or less, or 0.8 wt % or less, or 0.5 wt % or less. In one embodiment, the sulfated ash content may be 0.05 wt % to 0.9 wt %, or 0.1 wt % to 0.2 wt % to 0.45 wt %.

In one embodiment, the lubricating composition is an engine oil, wherein the lubricating composition is characterized as having at least one of (i) a sulfur content of 0.5 wt % or less, (ii) a phosphorus content of 0.1 wt % or less, and (iii) a sulfated ash content of 1.5 wt % or less. In one embodiment, the lubricating composition comprises less than 1.5% by weight unreacted polyisobutene, or less than 1.25%, or less than 1.0%.

In some embodiments, the lubricant composition is an engine oil composition for a turbocharged direct injection (TDI) engine.

Indeed the disclosed technology also provides a method of operating an engine comprising (1) supplying to the engine the lubricant composition described herein, and (2)

operating the engine. In some embodiments, the engine is a turbocharged direct injection (TDI) engine.

The disclosed technology also provides for a method of reducing deposits in a TDI engine, and in some embodiments a method of reducing piston deposits in a TDI engine. These methods include utilizing the described lubricant composition, containing the ashless saturated compound having a long chain hydrocarbyl polymer terminated by a hydroxyl group, in the operation of the engine.

The disclosed technology also provides for the use of an additive in a lubricant composition to reduce deposit control in a turbocharged direct injection (TDI) engine in which said lubricant composition is used, said additive comprising an ashless saturated compound having a long chain hydrocarbyl polymer terminated by a hydroxyl group.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: (i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); (ii) substituted hydrocarbon substituents, that is, substituents containing non-hydrocarbon groups which, in the context of the disclosed technology, do not alter the predominantly hydrocarbon nature of the substituent (e.g., halo (especially chloro and fluoro), hydroxy, alkoxy, mercapto, alkylmercapto, nitro, nitroso, and sulfoxy); (iii) hetero substituents, that is, substituents which, while having a predominantly hydrocarbon character, in the context of the disclosed technology, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the disclosed compositions, may not be susceptible of easy description. Nevertheless, all such modifications and reaction products are included within the scope of the present invention and the disclosed compositions encompass products formed by admixing the components and/or materials described above.

The following examples provide illustrations of the invention. These examples are non-exhaustive and are not intended to limit the scope of the invention.

EXAMPLES

Example A: Synthesis of Hydroxy Functionalized Ashless Derivative

Example A shows the synthesis of an additive using a predominantly a "high vinylidene PIB" ("HV PIB") with the terminal vinylidene groups (I) as shown in Table 1. A 5 L flange flask is charged with 1000 g of HV-PIB (1000 number average molecular weight, Mn) and the flask is then sufficiently purged with nitrogen to ensure complete nitrogen atmosphere. The reaction vessel is maintained under nitrogen. Dry hexane (500 ml) and tetrahydrofuran ("THF") (2,500 ml) are then added and the mixture is thoroughly mixed. The reaction is cooled to 5° C. Borane dimethyl sulfate (80 g) is added over about 25 minutes while maintaining the temperature at 5° C. The reaction is maintained at 5° C. for 60 minutes, and then is allowed to increase to room temperature overnight. The reaction is then cooled to 10° C. Aqueous NaOH (23 wt %, 260 g) is then slowly added via addition funnel in about 1 hour. The reaction is then cooled to 5° C. Hydrogen peroxide (291 g, 35 wt %) is added slowly over about 1.5 hours. The mixture is stirred overnight at room temperature. Part of the THF is removed, and hexane is added. The mixture is then placed into a 5 L separating funnel and allowed to settle. The organic layer is separated, and the aqueous layer is extracted with hexane. All organic layers are combined and washed with saturated $Na_2CO_3$, water and dried over $MgSO_4$. The dried organic extract is concentrated under reduced pressure at 155° C. for 2 hours.

Example B: Synthesis of Hydroxy Functionalized Ashless Derivative

Example B also shows the synthesis of an additive using a predominantly "high vinylidene PIB" ("HV PIB") with the terminal vinylidene groups (I) as shown in Table 1. Example B is similar to Example A, except the synthesis occurs under different reaction conditions. A 5 L flange flask is charged with 1500 g of HV-PIB (1000 Mn), and the flask is then sufficiently purged with nitrogen to ensure complete nitrogen atmosphere. The reaction vessel is maintained under nitrogen. Dry hexane (250 g) and THF (1,500 g) are then added and the mixture is thoroughly mixed. The reaction was cooled to −15° C. Borane dimethyl sulfate (80 g) is added over about 15 minutes. The reaction is maintained at −10° C. for 30 minutes then allowed to increase to room temperature. The reaction is stirred overnight then cooled to −15° C. Aqueous NaOH (25 wt %, 250 g) is then slowly added via addition funnel in about 2 hours. Hydrogen peroxide (204 g, 50 wt %) is slowly added. The mixture is then stirred overnight at room temperature, and then poured out of the reaction vessel into a large beaker and allowed to stand overnight. The mixture is placed into a 5 L separating funnel and allowed to settle. The organic layer is separated, and the aqueous layer extracted with hexane. All organic layers are combined and washed with saturated $Na_2CO_3$, water and dried over $MgSO_4$. The dried organic extract is concentrated under reduced pressure at 155° C. for 2 hours.

Example A and Example B may then be used to prepare two fully formulated engine oils.

Comparative Example C is a fully formulated engine lubricant based on a mixture of 100N and 150N API Group III base oils where the lubricant also includes a package of known additives. This package of additives includes a viscosity modifier, a pour point depressant, an antioxidant, a friction modifier, a detergent, an antiwear agent, a corrosion inhibitor, an antifoam agent, and a small amount diluent.

Example D is identical to Comparative Example C except that an ashless saturated compound having a long chain hydrocarbyl polymer terminated by a hydroxyl group is added to the lubricant at a treat rate of 1.0 percent by weight (i.e., the product of Example A). The formulations of Comparative Example C and Example D are summarized below where the component values shown are percent by weight. The reported phosphorus and sulfur contents of the examples were obtained by inductively coupled plasma (ICP) analysis.

TABLE 2

Composition of Lubricating Compositions

| Component | Comparative Example C | Example D |
|---|---|---|
| Base Oil | Balance to 100% | Balance to 100% |
| Example A | 0.0 | 1.0 |
| Calcium Detergents[1] | 1.29 | 1.29 |
| ZDDP[2] | 0.86 | 0.86 |
| Antioxidant[3] | 3.2 | 3.2 |
| Dispersant[4] | 4.97 | 4.97 |
| Viscosity Modifier[5] | 1.44 | 1.44 |
| Additional additives | 0.46 | 0.46 |
| % Phosphorus | 0.077 | 0.077 |
| % Sulfur | 0.25 | 0.25 |

Each lubricant is then tested using the CEC-L-78-99 (HTDI.392) engine test. This engine test evaluates direct injection diesel engine piston ring sticking and piston cleanliness in a Volkswagen 1.9 L turbocharged intercooled DI diesel engine having four pistons, i.e., a TDI engine. The engine is first flushed with the candidate oil and then subjected to a "running-in" phase. A 54-hour test is then run while the engine is alternated between idle and maximum power conditions. Upon completion of the 54-hour test, each piston is manually and visually inspected to determine piston ring sticking and to rate the cleanliness of the pistons. For piston ring sticking, a ring is considered "stuck" if it does not freely move in its groove when attempts to move it are made by hand. Both Comparative Example C and Example D did not have any stuck rings and passed the piston ring sticking portion of the test.

Piston cleanliness is a rating (points) that is assigned based on visual inspection of various areas of the piston. The regions of the piston that are inspected are, starting from the piston head, lands 1 and 2, and grooves, 1, 2, and 3. The top land is not measured. The points for a specific region are calculated as in the following formula.

$$100(A_{clean})+65(A_{discolored})+30(A_{black})+(-30)(A_{carbon})=\text{Points}$$

wherein ($A_{clean}$) is the area, in %, of the region that is clean; ($A_{discolored}$) is the area (%) of the region that is discolored, ($A_{black}$) is the area (%) of the region that is black, and ($A_{carbon}$) is the area (%) of the region that has carbon deposits.

For example, for Comparative Example C, the points for Piston 1, Land 1 were calculated as follows:

$$100(0.30)+65(0.24)+30(0.46)+(-30)(0)=59.4 \text{ points.}$$

The points for each region of each piston may then be averaged (divided by 4) as in the summary data shown in Table 3 below. The piston merit is the aggregate average of all the regions for all four pistons and is also shown in Table 3 below. It is noted that cleaner regions and/or pistons will have higher points than dirty regions and/or pistons.

TABLE 3

Piston Point Summary

| | Land 1 Average | Groove 2 Average | Piston Merit |
|---|---|---|---|
| Comparative Example C | 53.5 | 60.2 | 62 |
| Example D | 64.0 | 67.9 | 66 |

Comparative Example C provides a piston merit of 62 points. Example D provides a piston merit of 66 points. Example D provides an improvement in piston cleanliness over Comparative Example C, indicating the ashless additive of Example A will provide improved deposit control in TDI engines.

Accordingly, in one embodiment, the disclosed additive includes compounds having at least one of the following structures:

(i)

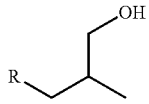

(ii)

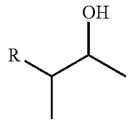

(v)

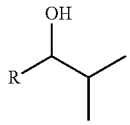

where R is a hydrocarbyl group. In another embodiment, the additive may include compounds having at least one structure, (i), (ii), (v), or combinations thereof with an average molecular weight (Mn) of about 1000 and wherein R is a hydrocarbyl group having a terminal vinylidene group as in formula I (I)

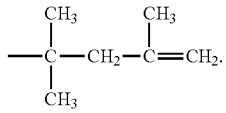

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricant composition comprising:

(i) an oil of lubricating viscosity;

(ii) 0.9 to 4% of an ashless saturated compound having a long chain polyisobutylene polymer, wherein said polyisobutylene polymer:

(a) is terminated by a hydroxyl group;

(b) has a number average molecular weight of from about 300 to about 3000; and (c) has a vinylidene content of at least 70 percent by weight.

2. The lubricant composition of claim 1 wherein the additive is prepared from a long chain polyisobutylene polymer by means of a hydroboration and oxidation sequence.

3. The lubricant composition of claim 1 wherein the additive is prepared by reacting a long chain polyisobutylene polymer with a borane derivative, and then reacting the resulting intermediate with a peroxide derivative and a base.

4. The lubricant composition of claim 1 wherein the additive is prepared by reacting a long chain polyisobutylene polymer with CO and $H_2$ in the presence of a metal catalyst, resulting in an aldehyde, and then completing a hydrogenation or a reduction of the aldehyde to the saturated alcohol.

5. The lubricant composition of claim 1 wherein said additive comprises compounds having at least one of the following structures:

(i)

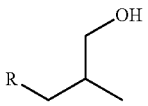

-continued (ii)

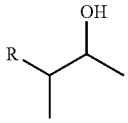

(iii)

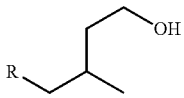

(iv)

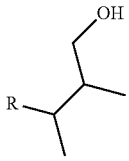

(v)

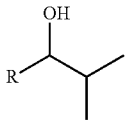

(vi)

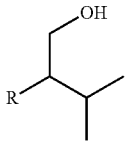

where R is a hydrocarbyl group containing from about 6 to about 596 carbon atoms.

6. The lubricant composition of claim 1 wherein the additive is prepared by reacting a long chain ethylenically unsaturated polyisobutylene polymer with a borane derivative, and then reacting the resulting intermediate with a peroxide derivative and a base.

7. The lubricant composition of claim 1 wherein the oil of lubricating viscosity comprises a mineral oil, a synthetic oil, or a combination thereof.

8. The lubricant composition of claim 1 wherein the lubricant composition further comprises (iii) an additive package, where the additive package comprises one or more viscosity modifiers, pour point depressants, antioxidants, friction modifiers, detergents, antiwear agents, corrosion inhibitors, antifoam agents, diluent oil, or any combination thereof.

9. A method of operating an engine comprising (1) supplying to the engine the lubricant composition of claim 1, and (2) operating the engine.

10. The method of claim 9 wherein the engine is a turbocharged direct injection (TDI) engine.

* * * * *